US008064797B2

(12) United States Patent
Sugiyama

(10) Patent No.: US 8,064,797 B2
(45) Date of Patent: Nov. 22, 2011

(54) IMAGE FORMING APPARATUS HAVING RELEASING MECHANISM FOR REMOVABLE TONER-IMAGE CONVEYANCE BELT

(75) Inventor: Shinichi Sugiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 12/258,250

(22) Filed: Oct. 24, 2008

(65) Prior Publication Data

US 2009/0110436 A1 Apr. 30, 2009

(30) Foreign Application Priority Data

Oct. 26, 2007 (JP) ..... 2007-279449

(51) Int. Cl.
*G03G 15/08* (2006.01)

(52) U.S. Cl. ..... 399/121; 399/297

(58) Field of Classification Search ..... 399/66, 399/121, 297, 308

See application file for complete search history.

(56) References Cited

U.S. PATENT DOCUMENTS

| | | | | |
|---|---|---|---|---|
| 2004/0228653 | A1* | 11/2004 | Yoshino | 399/121 |
| 2005/0019066 | A1* | 1/2005 | Ito et al. | 399/302 |
| 2006/0072929 | A1* | 4/2006 | Takahashi | 399/13 |

FOREIGN PATENT DOCUMENTS

| | | | |
|---|---|---|---|
| JP | 05-323797 | | 12/1993 |
| JP | 10-282803 | | 10/1998 |
| JP | 11-73035 | | 3/1999 |
| JP | 2001-172091 | | 6/2000 |
| JP | 2000-187400 | | 7/2000 |
| JP | 2004258693 | A * | 9/2004 |
| JP | 2007219373 | A * | 8/2007 |

* cited by examiner

*Primary Examiner* — David Gray

*Assistant Examiner* — G. M. Hyder

(74) *Attorney, Agent, or Firm* — Canon USA Inc IP Division

(57) ABSTRACT

An image forming apparatus includes an image bearing member, a rotatable belt member configured to contact the image bearing member, a belt unit configured to support the belt member and removably mounted on the image forming apparatus, an operation unit disposed on the belt unit, a belt unit moving mechanism configured to cause the belt member to contact the image bearing member when the operation unit is in a first position and to cause the belt member to separate from the image bearing member when the operation unit is in a second position, and a tensile force releasing mechanism configured to release a tensile force applied to the belt member when the belt unit is pulled out from the image forming apparatus and the operation unit is in a third position.

8 Claims, 17 Drawing Sheets

OPERATION LEVER TURNED 90 DEGREES CLOCKWISE WHEN ATTACHING AND DETACHING INTERMEDIATE TRANSFER UNIT

OPERATION LEVER TURNED 90 DEGREES CLOCKWISE WHEN ATTACHING AND DETACHING INTERMEDIATE TRANSFER UNIT

OPERATION LEVER TURNED 180 DEGREES CLOCKWISE
WHEN REPLACING INTERMEDIATE TRANSFER BELT

PRESS CONTACTING STATE (OPERATION LEVER TURNED 0 DEGREES)

SEPARATED STATE (OPERATION LEVER TURNED 90 DEGREES CLOCKWISE)

TENSILE FORCE RELEASED STATE
(OPERATION LEVER TURNED 180 DEGREES CLOCKWISE)

PRESS CONTACTING STATE (OPERATION LEVER TURNED 0 DEGREES)

SEPARATED STATE (OPERATION LEVER TURNED 90 DEGREES CLOCKWISE)

TENSILE FORCE RELEASED STATE
(OPERATION LEVER TURNED 180 DEGREES CLOCKWISE)

IMAGE FORMING APPARATUS HAVING RELEASING MECHANISM FOR REMOVABLE TONER-IMAGE CONVEYANCE BELT

BACKGROUND OF THE INVENTION

1. Field of the Invention

The present invention relates to an image forming apparatus in which a toner-image conveyance belt unit can be integrally pulled out from an image forming position to a toner-image conveyance belt replacement position, and more particularly, the present invention relates to a mechanism for manually releasing the tensile force applied to a toner-image conveyance belt after separating a transfer unit from an image bearing member.

2. Description of the Related Art

There is an image forming apparatus in which one or more image bearing members are disposed along a toner-image conveyance belt (such as an intermediate transfer belt or a recording material conveyance belt). In the image forming apparatus including the toner-image conveyance belt, a toner-image conveyance belt unit is supported so that a user can pull out the toner-image conveyance belt unit from a normal image forming position to a toner-image conveyance belt replacement position. The toner-image conveyance belt replacement position includes a toner-image conveyance belt unit replacement position and a maintenance position.

Japanese Patent Application Laid-Open No. 2000-172091 discusses an image forming apparatus in which an intermediate transfer unit supported by a guide rail can be pulled out horizontally along the rotational direction of the intermediate transfer belt. The intermediate transfer unit can be integrally pulled out upwards. When a user pulls out the intermediate transfer unit to replace the intermediate transfer belt, the tensile force applied to the intermediate transfer belt can be changed to release the belt.

Further, Japanese Patent Application Laid-Open No. 2000-187400 discusses an image forming apparatus in which an intermediate transfer unit can be pulled out horizontally along a rotational direction of an intermediate transfer belt. Consequently, the intermediate transfer unit is released from an abutting state against a photosensitive drum.

Further, Japanese Patent Application Laid-Open No. 2000-73035 discusses a tandem-type image forming apparatus in which a plurality of photosensitive drums are arranged along an intermediate transfer belt. An intermediate transfer unit can be pulled out in an axial direction of the photosensitive drum (i.e., in a direction perpendicular to a cross section surface of a rotational direction of the intermediate transfer belt). Further, a transfer roller that press-contacts the photosensitive drum via the intermediate transfer belt forms a transfer portion that can move up and down. The transfer roller is moved down before the intermediate transfer unit is pulled out, so that the intermediate transfer belt does not abrade the photosensitive drum when a user pulls out the intermediate transfer unit.

Further, Japanese Patent Application Laid-Open No. 05-323797 and Japanese Patent Application Laid-Open No. 10-282803 discuss an image forming apparatus that includes an operation lever. The operation lever is used to manually release the tensile force applied to an intermediate transfer belt while separating the intermediate transfer belt from a photosensitive drum. The operation lever is disposed on a side that is parallel to a cross section surface along a rotational direction of the intermediate transfer belt.

However, as illustrated in Japanese Patent Application Laid-Open No. 05-323797 and Japanese Patent Application Laid-Open No. 10-282803, if the tensile force applied to the intermediate transfer belt is released when the intermediate transfer unit is in a normal image forming position, the intermediate transfer belt hangs down. As a result, the intermediate transfer belt may contact a casing member below the intermediate transfer belt. If a user pulls out the intermediate transfer unit from the casing in such a state, the intermediate transfer belt may be stained or folded. In the result, the belt may become unusable.

In order to solve such a problem, an abutting/separating mechanism which abuts and separates the intermediate transfer belt against and from the photosensitive drum and a tensile force releasing mechanism that releases the tensile force applied to the intermediate transfer belt can be independently formed. However, in such a case, a user may operate the wrong operation lever if the operation levers are located adjacent each other.

SUMMARY OF THE INVENTION

The present invention is directed to an image forming apparatus in which an intermediate transfer belt can be pulled out to a maintenance position and can be loosened to make the belt removable after separating the belt from a photosensitive drum. In such an image forming apparatus, a user can manually perform the operations without fail.

According to an aspect of the present invention, an image forming apparatus includes an image bearing member, a belt member configured to be rotatable and to contact the image bearing member, a belt unit configured to support the belt member and removably mounted on the image forming apparatus, an operation unit disposed on the belt unit, a belt unit moving mechanism configured to cause the belt member to contact the image bearing member when the operation unit is in a first position and to cause the belt member to separate from the image bearing member when the operation unit is in a second position, and a tensile force releasing mechanism configured to release a tensile force applied to the belt member when the belt unit is pulled out from the image forming apparatus and the operation unit is in a third position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

According to an exemplary embodiment of the present invention, a user can control with a single operation lever to separate and release a tensile force applied to an intermediate transfer belt or a recording material conveyance belt. The present invention can be realized by other exemplary embodiments in which a part or whole of each of the exemplary embodiments to be described below is replaced by an alternative configuration.

The present invention is not limited to an image forming apparatus using an intermediate transfer belt. The present invention can be realized by an image forming apparatus that transfers a toner image to a recording material carried by a recording material conveyance belt. Further, the present invention is not limited to a single drum type image forming apparatus in which one photosensitive drum is disposed along a toner-image conveyance belt. The present invention can be realized by a tandem type image forming apparatus in which a plurality of photosensitive drums is disposed along a toner-image conveyance belt.

In the present exemplary embodiment, a main portion of the image forming apparatus that is related to forming and transferring a toner image is described. However, the present invention can be realized in various usages, such as printers, various types of printing machines, copying machines, facsimile machines, and multifunction peripherals, by adding requisite devices, equipments, and casing.

First Exemplary Embodiment

Figure 1:
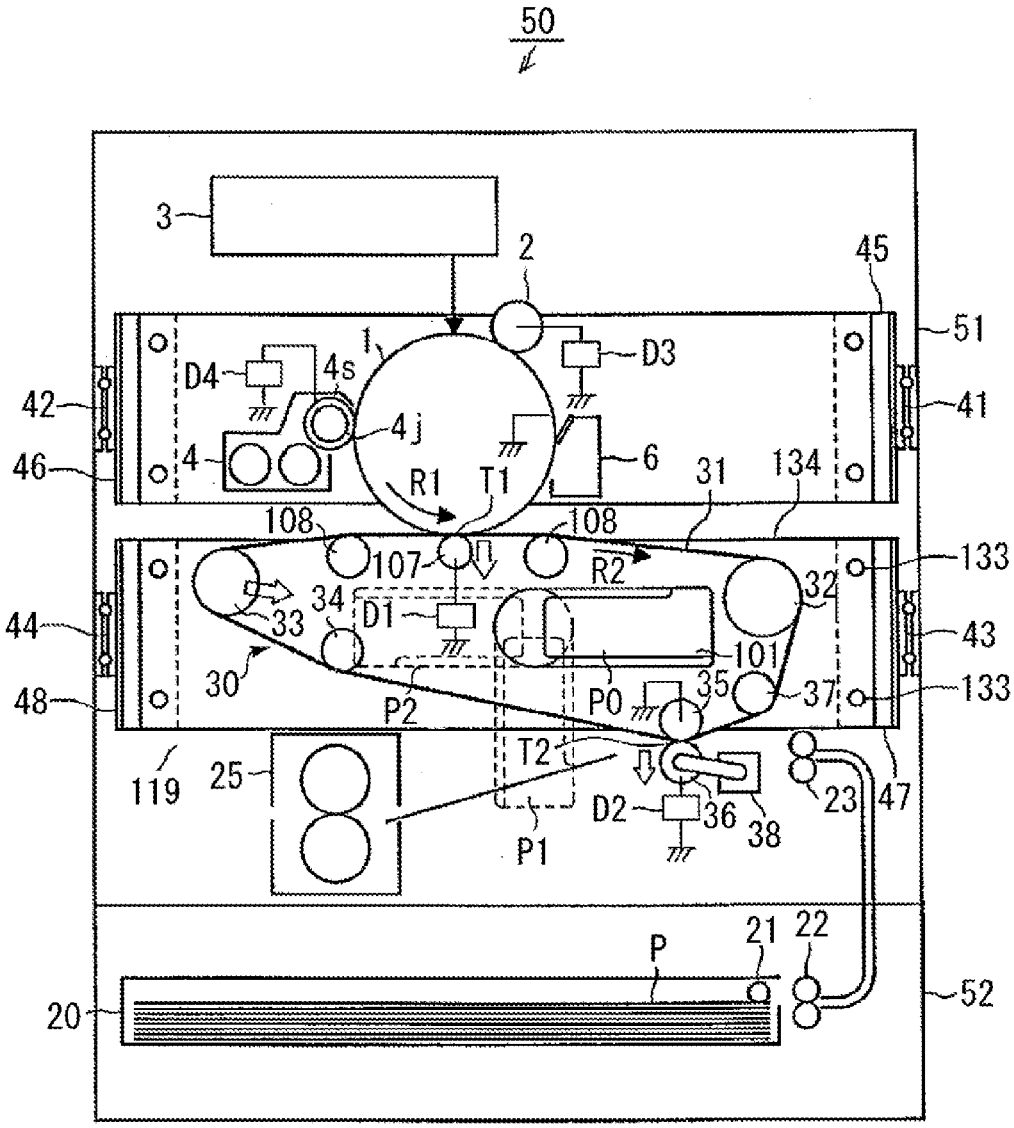
FIG. 1 illustrates a configuration of an image forming apparatus according to a first exemplary embodiment of the present invention.
Figure 2:
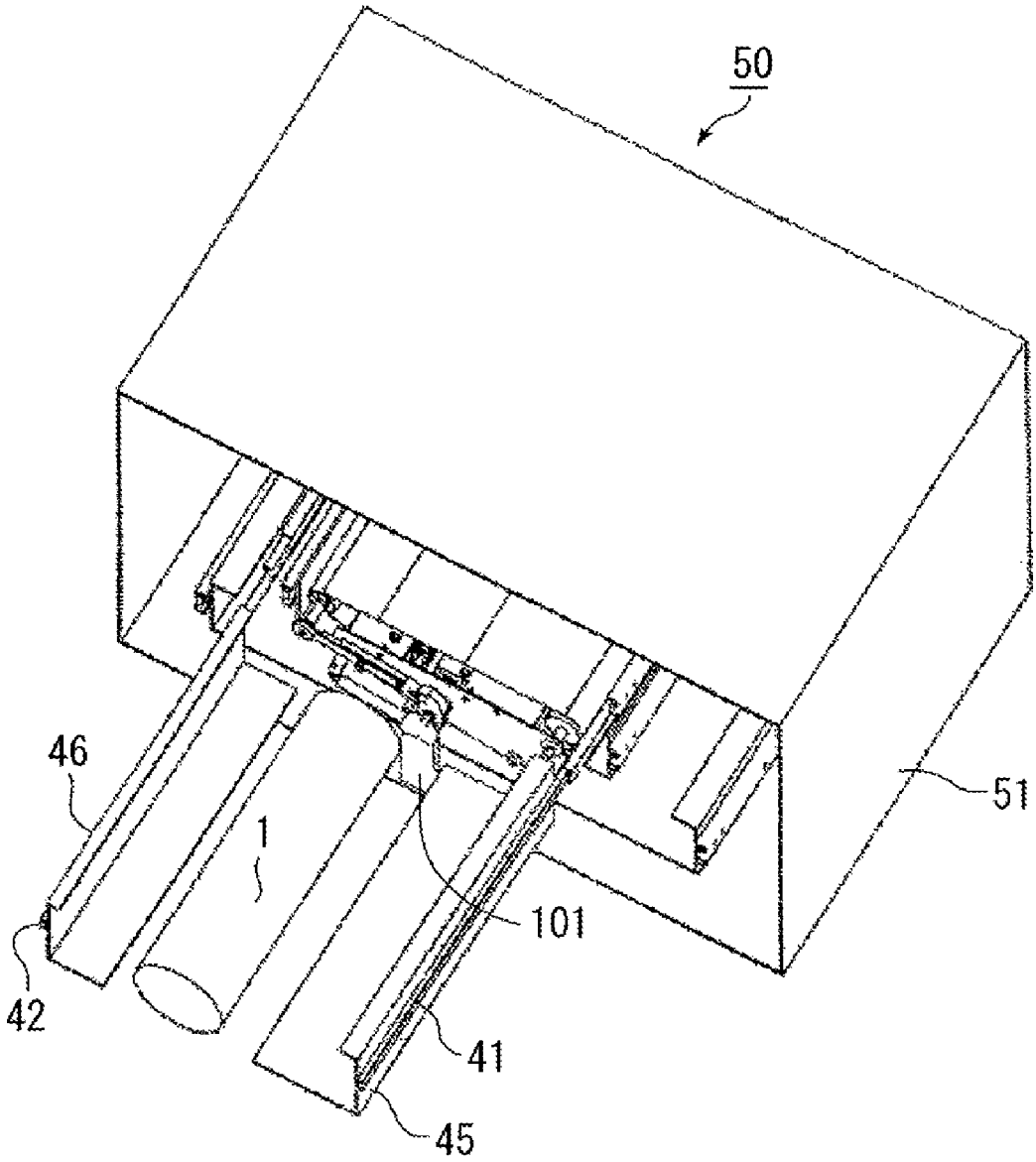
FIG. 2 illustrates a pullout structure of a photosensitive drum.
Figure 3:
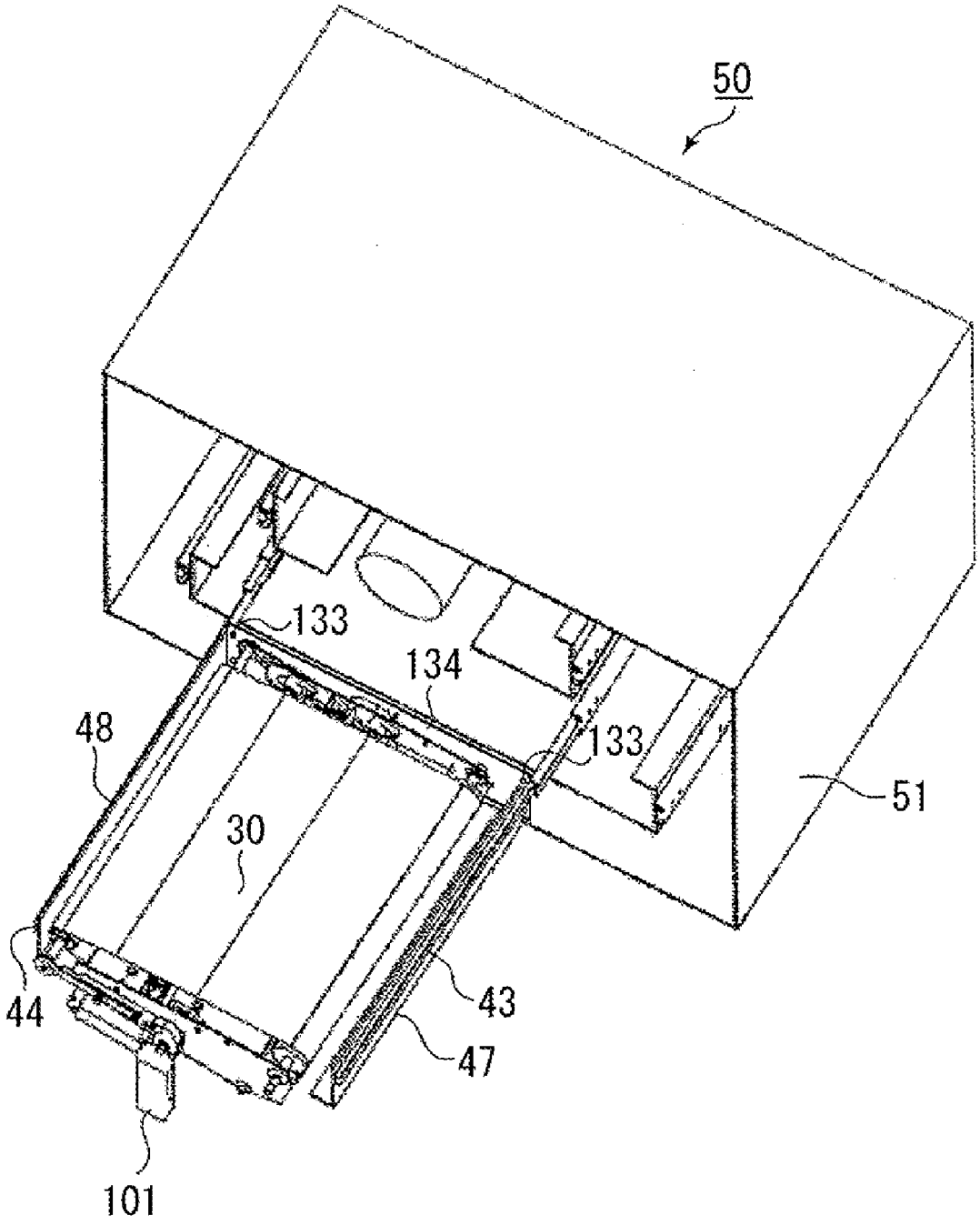
FIG. 3 illustrates a pullout structure of an intermediate transfer unit.

FIG. 1 illustrates a configuration of the image forming apparatus according to a first exemplary embodiment of the present invention. FIG. 2 illustrates a pullout structure of a photosensitive drum, and FIG. 3 illustrates a pullout structure of an intermediate transfer unit.

Referring to FIG. 1, an image forming apparatus 50 according to the first exemplary embodiment is a monochrome printer in which a photosensitive drum 1 is disposed at a linear portion of an intermediate transfer belt 31.

An image forming unit 51 includes the photosensitive drum 1, around which a charging device 2, an exposure device 3, a developing device 4, a transfer roller 107, and a cleaning device 6 are disposed. The photosensitive drum 1, the charging device 2, the developing device 4, and the cleaning device 6 are integrally assembled as a process cartridge that can be replaced together.

The photosensitive drum 1 is a metal cylinder on whose surface a photosensitive layer of a negative polarity is formed. The photosensitive drum 1 rotates in a direction indicated by an arrow R1 illustrated in FIG. 1 at a predetermined process speed.

The charging device 2 includes a charging roller, which is configured to rotate while press-contacting the photosensitive drum 1.

A power source D3 applies to the charging roller a voltage in which a direct current (DC) voltage and an alternating current (AC) voltage are superimposed. Consequently, the power source D3 uniformly charges the surface of the photosensitive drum 1 to a potential of negative polarity.

The exposure device 3 scans a laser beam that is on-off modulated with scanning-line image data acquired by rasterizing image data. The laser beam is scanned using a polygon mirror to form an electrostatic image on the charged surface of the photosensitive drum 1.

The developing device 4 rotates a developing sleeve 4*s*, which carries a negatively-charged toner, around a fixed magnetic pole 4*j* in the counter direction to the photosensitive drum 1. A power source D4 applies a developing voltage, in which an AC voltage is superimposed on a DC voltage of negative polarity, to the developing sleeve 4*s*. Consequently, the power source D4 is used to adhere toner to an exposed portion of the electrostatic image on the photosensitive drum 1 and performs reverse-development of the electrostatic image.

The transfer roller 107 press-contacts the photosensitive drum 1 via the intermediate transfer belt 31 to form a primary transfer portion T1 between the photosensitive drum 1 and the intermediate transfer belt 31. The primary transfer portion T1 sandwiches the intermediate transfer belt 31 contacting the negatively-charged toner image on the photosensitive drum 1, and conveys the intermediate transfer belt 31 in the direction indicated by an arrow R2.

The power source D1 then applies a positive DC voltage to the transfer roller 107 to perform primary transfer of the toner image on the photosensitive drum 1 onto the intermediate transfer belt 31.

The cleaning device 6 removes the toner that is left on the surface of a portion of the photosensitive drum 1 after the portion has passed through the primary transfer portion T1. The photosensitive drum 1 is thus prepared for the next toner image forming.

The toner image primarily transferred onto the intermediate transfer belt 31 is then conveyed to a secondary transfer portion T2 and is secondarily transferred onto a recording material P.

A pick-up roller 21 takes out the recording material P from a recording material storage cassette 20 of a paper feed unit 52. The recording material P is then separated one by one by a separating unit 22 and is transferred to a registration roller 23. The registration roller 23 feeds the recording material P to the secondary transfer portion T2 in synchronization with the toner image on the intermediate transfer belt 31.

A secondary transfer roller 36 press-contacts an opposing roller 35 via the intermediate transfer belt 31, thus forming a secondary transfer portion T2 between the intermediate transfer belt 31 and the secondary transfer roller 36. The secondary transfer portion T2 sandwiches the recording material P contacting the toner image of the intermediate transfer belt 31, and conveys the recording material P.

The power source D2 applies a positive voltage on the secondary transfer roller 36 to perform secondary transfer of the negatively-charged toner image carried on the intermediate transfer belt 31 onto the recording material P.

The toner image transferred onto the recording material P is pressed and heated by a fixing device 25 and fixed thereon. The recording material P is then discharged outside the image forming unit 51.

A secondary transfer abutting/separating mechanism 38 vertically moves up/down the secondary transfer roller 36 to abut and separate the secondary transfer portion T2 against and from the intermediate transfer belt 31. The secondary transfer roller 36 is separated from the intermediate transfer belt 31 by the secondary transfer abutting/separating mechanism 38 except during image forming, to prevent permanent deformation of the secondary transfer roller 36.

Pullout frames 45 and 46 can be pulled out towards the front direction (in an axial direction of the photosensitive drum 1) along linear guides 41 and 42. The photosensitive drum 1 (i.e., a process cartridge) is removably supported by the pullout frames 45 and 46.

Referring to FIG. 2, a user can mount or remove the photosensitive drum 1 (process cartridge) on and from the pullout frames 45 and 46, when the pullout frames 45 and 46 are pulled out towards the front direction.

Further, as illustrated in FIG. 1, the intermediate transfer belt 31 is supported by a driving roller 32, a tension roller 33, a support roller 34, a counter roller 35, a support roller 37, the transfer roller 107, and transfer surface regulating rollers 108 therearound. They are assembled as the intermediate transfer unit 30 and can be handled together as a unit.

Referring to FIG. 3, the intermediate transfer unit 30 is supported by pullout frames 47 and 48, which can be pulled out towards the front direction (in a direction perpendicular to a cross section surface along a rotational direction of the intermediate transfer belt 31) along linear guides 43 and 44. The intermediate transfer unit 30 is thus removably mounted on the pullout frames 47 and 48.

The intermediate transfer unit 30 is removably mounted on the linear guides 43 and 44 by fixing screws 133 via the pullout frames 47 and 48, which are integrally mounted on the linear guides 43 and 44. Further, the intermediate transfer unit 30 is mounted on the linear guides 43 and 44 in the form of a cantilever that is supported at the back of the linear guides 43 and 44. A frame 132 (refer to FIG. 4) positioned on a backside of the intermediate transfer unit 30 is mounted onto an attachment plate 134.

Further, a frame 131 (refer to FIG. 4) on the front side of the intermediate transfer unit 30 is smaller than a cross section surface of the rotational direction of the intermediate transfer belt 31. Consequently, there is a space between the frame 131 and the pullout frames 47 and 48, so that the intermediate transfer unit 30 can be pulled out towards the front.

Referring to FIG. 3, the intermediate transfer unit 30 can be removed from the pullout frames 47 and 48 by removing the fixing screw 133 when the pullout frames 47 and 48 are pulled out towards the front direction.

Figure 4:
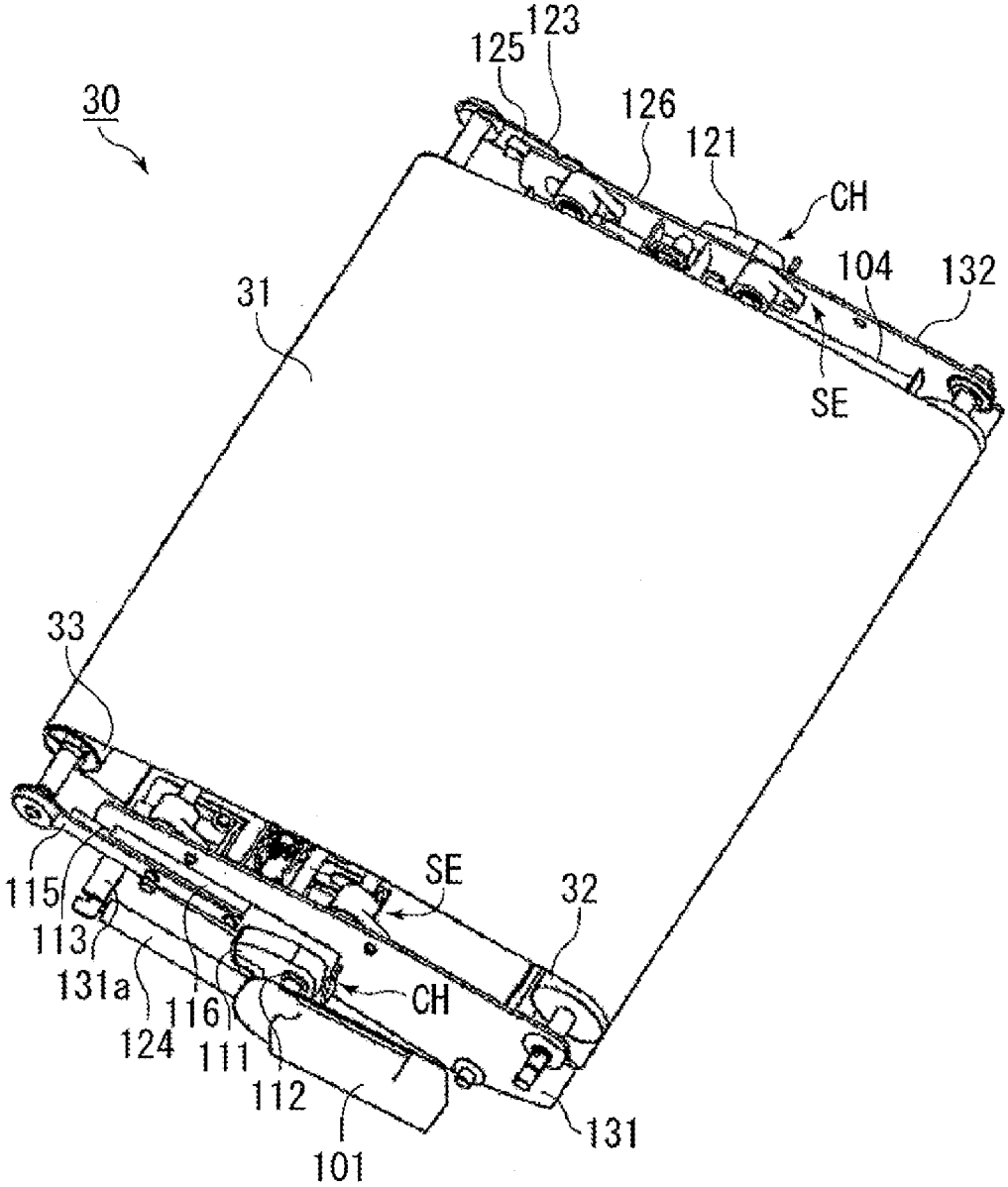
FIG. 4 illustrates a perspective view of the intermediate transfer unit.

Then, a user can grip an operation lever 101 illustrated in FIG. 4, disposed on the front side of the intermediate transfer unit 30, to pull out the intermediate transfer unit 30 towards the front direction.

If the user further turns the operation lever 101 by one step when the intermediate transfer unit 30 is pulled out towards the front direction, a tensile force applied to the intermediate transfer belt 31 can be released as will be described below.

Further, if the user grips the operation lever 101 and lifts the intermediate transfer unit 30 upward, the intermediate transfer unit 30 can be removed from the pullout frames 47 and 48.

The user can further carry the intermediate transfer belt 30 while gripping the operation lever 101 as a handle. At this time, the tensile force applied to the intermediate transfer belt 30 is not released enough to be removed. Therefore, the intermediate transfer belt 31 will not fall out from the intermediate transfer unit 30 even when the rotational surface is turned upright.

As described above, the toner-image conveyance belt (the intermediate transfer belt 31) contacts the image bearing member (the photosensitive drum 1) that bears a toner image to form a transfer portion (the primary transfer portion T1). The toner-image conveyance belt (the intermediate transfer belt 31) conveys the toner image transferred at the transfer portion (the primary transfer portion T1). The toner-image conveyance belt unit (the intermediate transfer unit 30) includes a supporting mechanism that supports the toner-image conveyance belt (the intermediate transfer belt 31).

Figure 5:
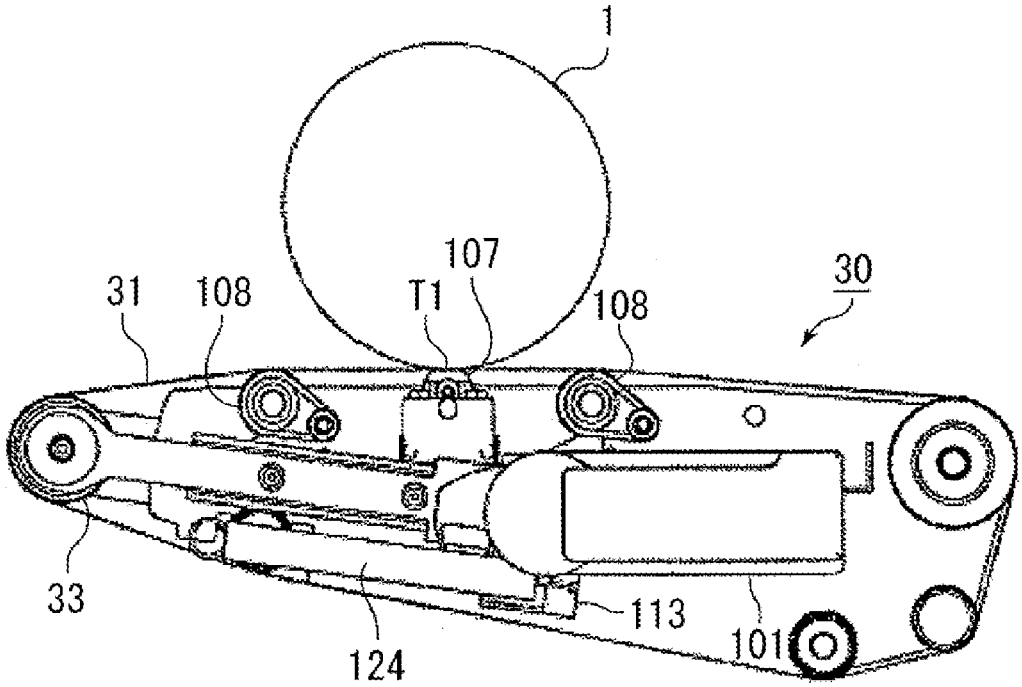
FIG. 5 illustrates a state in which an operation lever is turned to a press-contact position.
Figure 6:
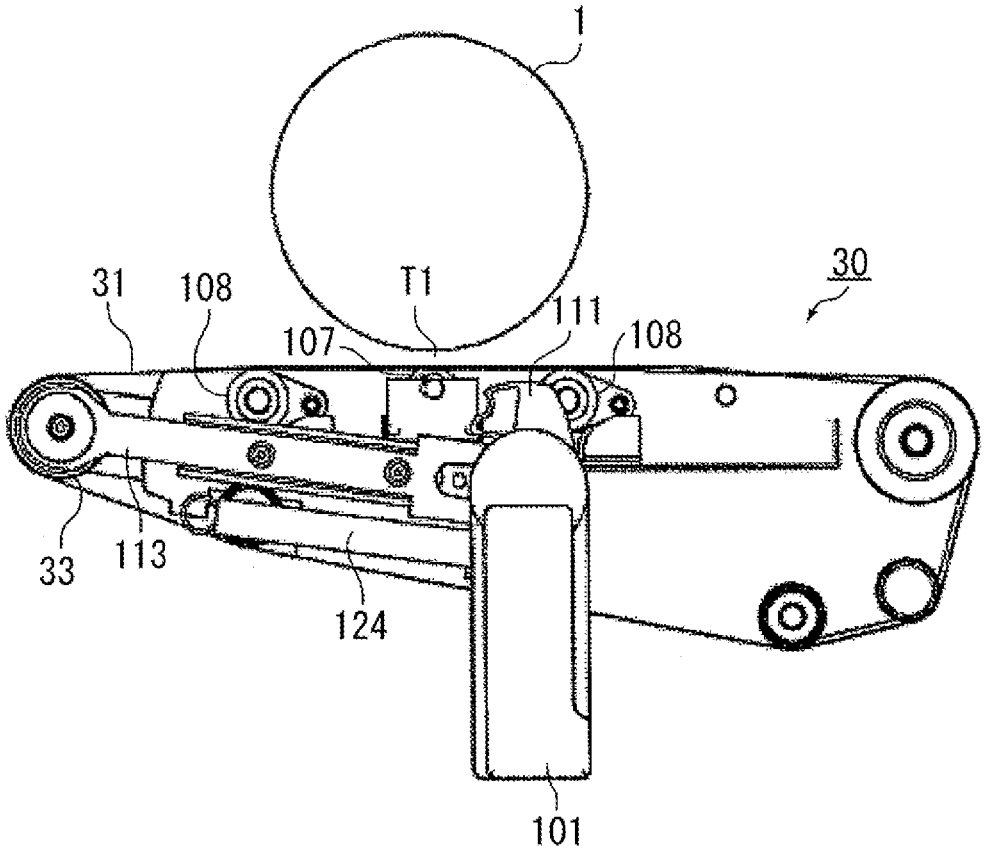
FIG. 6 illustrates a state in which the operation lever is turned to a separate position.
Figure 7:
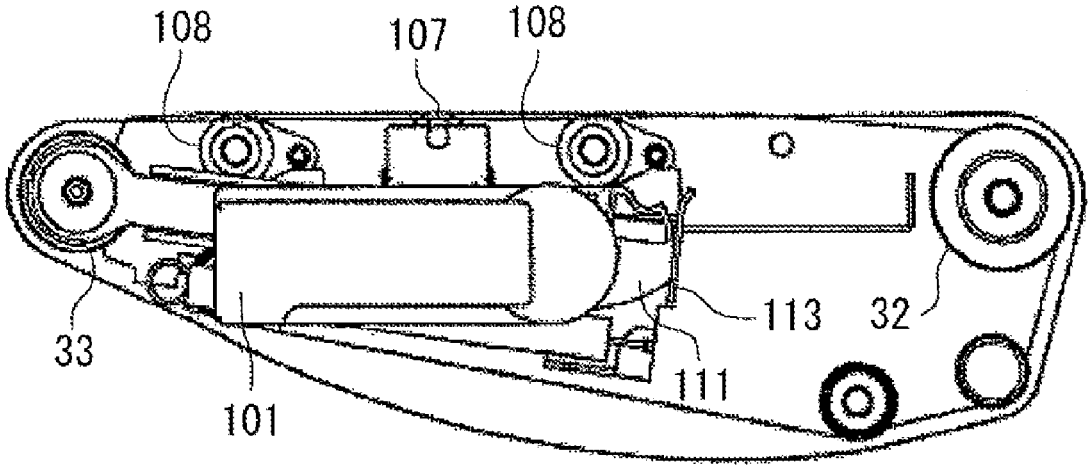
FIG. 7 illustrates a state in which the operation lever is turned to a release position.

FIG. 4 illustrates a perspective view of the intermediate transfer unit 30. FIG. 5 illustrates a state of the intermediate transfer unit 30 when a user turns the operation lever 101 to a press-contact position. FIG. 6 illustrates a state of the intermediate transfer unit 30 when a user turns the operation lever 101 to a separate position. FIG. 7 illustrates a state of the intermediate transfer unit 30 when a user turns the operation lever 101 to a release position.

Referring to FIG. 4, the intermediate transfer unit 30 is assembled between the frames 131 and 132, which constitute a casing. The frames 131 and 132 rotatably support the driving roller 32, the supporting rollers 34 and 37, and the counter roller 35 at the both ends of the rollers.

A slider 113 is held to be movable linearly on a slide rail 116 mounted on the frame 131. A bearing holder 115 that supports the tension roller 33 is mounted rotatably on the slider 113.

One end of a spring 124 is latched on the slider 113 on the opposite side of the tension roller 33. The other end of the spring 124 is latched on a protrusion 131*a* mounted on the frame 131. The spring 124 thus biases the slider 113 towards the tension roller 33 along the slide rail 116.

Similarly, a slide rail 126 and a slider 123 are disposed on the frame 132, and a bearing holder 125 that supports the tension roller 33 rotatably is mounted on the slider 123. The slider 123 is biased by a spring (not illustrated) to push the tension roller 33 outwards along the slide rail 126.

As a result, the tension roller 33 applies a tensile force to the intermediate transfer belt 31 by a biasing force of the spring 124 and the spring on the frame 132 (not illustrated). The tensile force applied to the intermediate transfer belt 31 can be released by linearly moving the sliders 113 and 123 inwards against the biasing force of the spring 124 and the spring on the frame 132 (not illustrated) to reduce protrusion of the tension roller 33 from the frames 131 and 132.

The large operation lever 101, which is used as a handle for both pulling out and carrying the intermediate transfer unit 30, is disposed at the center of the front side of the intermediate transfer unit 30. There is a space between the operation lever 101 and the frame 131 so that the user can insert the user's fingers.

Referring to FIG. 1, the operation lever 101 can be turned to three positions, i.e., a press-contact position P0, a separate position P1, and a release position P2, with a clicking feeling.

When a user turns the operation lever 101 to the press-contact position P0, the transfer roller 107 is lifted, and the intermediate transfer belt 31 press-contacts the photosensitive drum 1 with a tensile force applied thereto.

When the user turns the operation lever 101 to the separate position P1, the transfer roller 107 is lowered, and the intermediate transfer belt 31 is separated from the photosensitive drum 1 with a tensile force applied thereto.

When the user turns the operation lever 101 to the release position P2, the tension roller 33 moves in the direction of an arrow illustrated in FIG. 1 and is then pulled inwards. The tensile force applied to the intermediate transfer belt 31 is thus released.

FIG. 5 illustrates the state of the intermediate transfer unit 30 when the user turns the operation lever 101 to the press-contact position P0 illustrated in FIG. 1. Then, the transfer roller 107 and a pair of transfer surface regulating rollers 108 are moved up, so that the intermediate transfer belt 31 press-contacts the photosensitive drum 1. The slider 113, on which the tension roller 33 is mounted, biases the inner surface of the intermediate transfer belt 31 outwards by a biasing force of the spring 124. The slider 113 thus applies a predetermined tensile force to the intermediate transfer belt 31. The slider 123, illustrated in FIG. 4 positioned on the opposite side thereof, is configured similarly.

As a result, if the photosensitive drum 1 and the intermediate transfer belt 31 are rotated, image forming can be performed. That is, a toner image formed on the photosensitive drum 1 is primarily transferred to the intermediate transfer belt 31 at the primary transfer portion T1 illustrated in FIG. 1.

FIG. 6 illustrates a state of the intermediate transfer unit 30 when the user turns the operation lever 101 to the separate position P1 illustrated in FIG. 1. Then, the transfer roller 107 and the pair of transfer surface regulating rollers 108 are lowered, so that the intermediate transfer belt 31 is separated from the photosensitive drum 1. The slider 113, on which the tension roller 33 is mounted, biases the inner surface of the intermediate transfer belt 31 outwards by the bias force of the spring 124. The slider 113 thus applies a predetermined tensile force to the intermediate transfer belt 31. The slider 123, illustrated in FIG. 4 on the opposite side thereof, is configured similarly.

As a result, the user can pull out the intermediate transfer unit 30 towards the front direction as illustrated in FIG. 3 while the photosensitive drum 1 is separated from the intermediate transfer belt 31. The user can pull out the intermediate transfer unit 30 towards the front direction with a small force without frictional resistance and without scratching the photosensitive drum 1 and the intermediate transfer belt 31.

Further, a normal tensile force is applied to the intermediate transfer belt 31 even during the pullout process. Consequently, the intermediate transfer belt 31 does not contact the secondary transfer roller 36 even when the secondary transfer abutting/separating mechanism 38 illustrated in FIG. 1 separates the secondary transfer roller 36 only by a small amount. As a result, the intermediate transfer belt 31 is not in danger of jamming with other mechanisms and members including the fixing device 25 that are densely disposed around the intermediate transfer belt 31.

Further, since a normal tensile force is applied to the intermediate transfer belt 31 at the pullout position, the intermediate transfer belt 31 will not deviate to one side when the wipe-cleaning or the appearance check of the intermediate transfer belt 31 is performed. Wrinkles and folds are not formed on the intermediate transfer belt 31. If the user returns the intermediate transfer unit 30 into the casing without replacement of the intermediate transfer belt 31 to press-contact the intermediate transfer belt 31 to the photosensitive drum 1 again, the primary transfer portion T1 of the image forming process performed before the user pulled out the intermediate transfer belt 31 is reproduced.

FIG. 7 illustrates a state of the intermediate transfer unit 30 when the user turns the operation lever 101 to the release position P2 illustrated in FIG. 1. A release cam 111 that rotates together with the operation lever 101 moves the slider 113 towards the driving roller 32 against the bias force of the spring 124. Consequently, the tension roller 33 mounted on the opposite side of the slider 113 is pulled inwards and it does not push the inner surface of the intermediate transfer belt 31 outwards anymore.

Referring to FIG. 4, a release cam 121 similarly moves the slider 123 arranged on the opposite side of the slider 113 towards the driving roller 32 against the bias force of the spring (not illustrated). Consequently, the tension roller 33 is pulled inwards.

As a result, the tensile force applied to the intermediate transfer belt 31 is reduced, and the intermediate transfer belt 31 moves along the axial direction of the tension roller 33 and the driving roller 32. The intermediate transfer belt 31 can thus be easily removed from the intermediate transfer unit 30.

As described above, according to the first exemplary embodiment, an operation unit (the operation lever 101) works as a handle when a user moves the toner-image conveyance belt unit (the intermediate transfer unit 30) to the removal position. The toner-image conveyance belt (the intermediate transfer belt 31) is separated from the photosensitive drum 1 by moving the operation unit (the operation lever 101) from a first position (the press-contact position P0) to a second position (the separate position P1). Further, the toner-image conveyance belt is loosened by moving the operation unit 101 to a third position (the release position P2) via the second position (the separate position P1).

If the user moves the toner-image conveyance belt (the intermediate transfer belt 31) towards a direction in which it is removed from the supporting mechanism while the operation unit (the operation lever 101) is in the second position (the separate position P1), the toner-image conveyance belt (the intermediate transfer belt 31) contacts the operation unit (the operation lever 101).

In the first exemplary embodiment, a rotating step of the operation unit (the operation lever 101) for releasing the tensile force applied to the toner-image conveyance belt (the intermediate transfer belt 31) is disposed after a rotating step of the operation unit (the operation lever 101) for separating the toner-image conveyance belt (the intermediate transfer belt 31) from the image bearing member (photosensitive drum 1). As a result, the user cannot choose a wrong operation unit or make an error in a rotation operation.

Since there is only one operation unit (the operation lever 101), a user can operate the operation unit with a small force even if the operation unit is disposed in a small space, because a sufficient rotation radius can be secured. Further, a user can pull out the intermediate transfer belt 31 to a maintenance position after separating the intermediate transfer belt 31 from the photosensitive drum 1. The user can then manually loosen the intermediate transfer belt 31 with a small force and without error, so that the intermediate transfer belt 31 can be removed. Therefore, even a user who is not skilled can clean and check the intermediate transfer belt 31 in a short time.

Referring to FIG. 4, a stay 104, which is a plate-shaped rigid member, connects the frames 131 and 132 together. Abutting/separating mechanisms SE are disposed on the stay 104 near the frames 131 and 132.

A rotary shaft 112 of the operation lever 101 is pivotally supported to be rotated between the frames 131 and 132. When a user turns the operation lever 101, a pair of abutting/separating mechanisms SE integrally moves together. The pair of abutting/separating mechanisms SE is similarly configured except that the mechanical arrangement is symmetrical. The abutting/separating mechanism SE displaced near the frame 131 will be described below.

Figure 8:
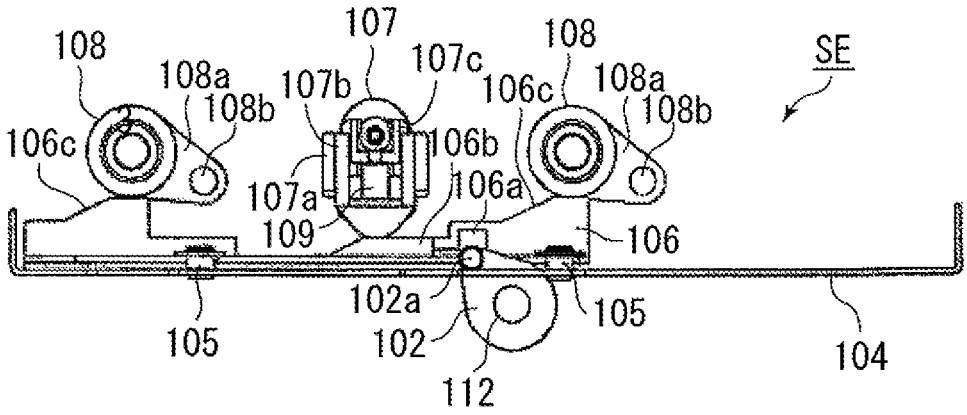
FIG. 8 illustrates an abutting/separating mechanism when the operation lever is turned to a press-contact position.
Figure 9:
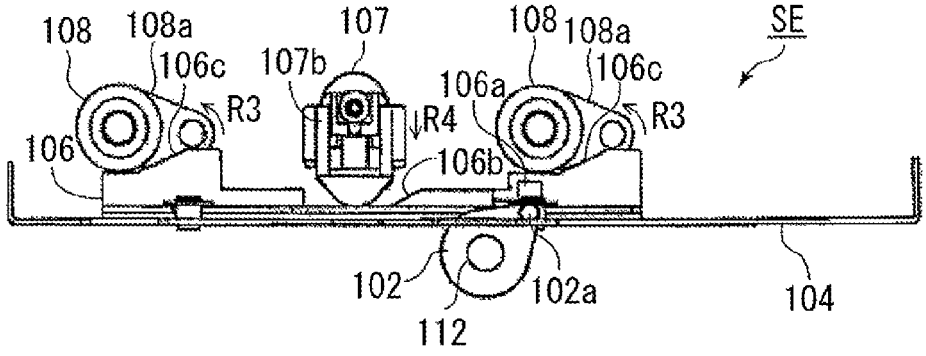
FIG. 9 illustrates the abutting/separating mechanism when the operation lever is turned to a separate position.
Figure 10:
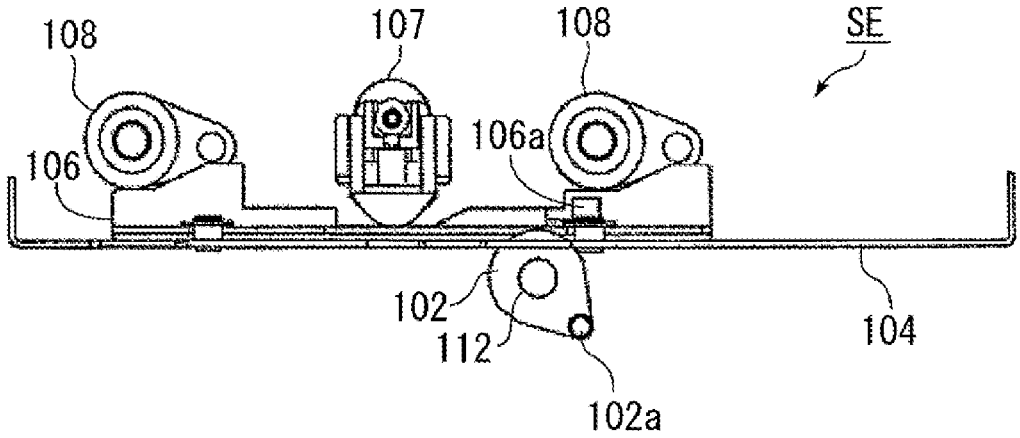
FIG. 10 illustrates the abutting/separating mechanism when the operation lever is turned to a release position.

FIGS. 8, 9, and 10 illustrate the abutting/separating mechanism according to the first exemplary embodiment of the present invention. FIG. 8 illustrates a state of the intermediate transfer unit 30 when the user turns the operation lever 101 of the abutting/separating mechanism to a press-contact position. FIG. 9 illustrates a state of the intermediate transfer unit 30 when the user turns the operation lever 101 to a separate position. FIG. 10 illustrates a state of the intermediate transfer unit 30 when the user turns the operation lever 101 to a release position.

Referring to FIG. 8, a link arm 102 is mounted on the rotary shaft 112. A pin-shaped projection 102*a* is formed at a leading end of the link arm 102.

A slide cam 106 has a pair of elongated holes. A pair of pins 105 mounted on the stay 104 fits in the elongated holes. Consequently, the slide cam 106 is linearly movable in a horizontal direction in FIG. 8.

The projection 102*a* of the link arm 102 fits in a slit 106*a* of the slide cam 106. Therefore, the slide cam 106 moves in the horizon direction in FIG. 8 according to a turning position of the link arm 102.

When the slide cam 106 moves in the horizontal direction in FIG. 8 along the stay 104, guide surfaces 106*b* and 106*c* that form a cam shape move the transfer roller 107 and the pair of transfer surface regulating rollers 108 vertically.

Both ends of the transfer roller 107 are pivotally supported by an internal holder 107*c* that is vertically movable with respect to a transfer roller holder 107*b*. The transfer roller holder 107*b* is supported inside a transfer roller casing 107*a* to be vertically movable. A spring 109 is disposed between the transfer roller holder 107*b* and the internal holder 107*c*. The spring 109 is used to set a predetermined transfer pressure on the primary transfer portion T1 illustrated in FIG. 1 when the transfer roller 107 press-contacts the intermediate transfer belt 31.

The guide surface 106*b* of the slide cam 106 press-contacts a lower portion of the transfer roller casing 107*a*. The guide surface 106*b* pushes the transfer roller holder 107*b* up to the position of the height of the guide surface 106*b* corresponding to the position of the slide cam 106 along the stay 104.

Both ends of the transfer surface regulating roller 108 are pivotally supported to be rotatable with respect to a holder 108*a*, which is rotatable around a rotary shaft 108*b*.

The guide surface 106*c* of the slide cam 106 press-contacts a lower portion of the holder 108*a*. The guide surface 106*c* pushes the holder 108*a* up to the position of the height of the guide surface 106*c* corresponding to the position of the slide cam 106 along the stay 104.

In a press-contacting state of the transfer roller 107 illustrated in FIG. 8, the projection 102*a* of the link arm 102 is engaged with the slit 106*a* of the slide cam 106. Consequently, the projection 102*a* positions the slide cam 106 at a starting position (i.e., left end) of a back and forth movement.

At this time, the guide surface 106*b* abuts a linear portion of the top dead center position against a lower portion of the transfer roller holder 107*b* and positions the transfer roller 107 at the highest position. Further, the guide surface 106*c* abuts a linear portion of the top dead center position against the holder 108*a* and positions the transfer surface regulating roller 108 at the highest position.

In a separated state of the transfer roller 107 illustrated in FIG. 9, the projection 102*a* of the link arm 102 is engaged with the slit 106*a* of the slide cam 106. Consequently, the projection 102*a* positions the slide cam 106 at a termination position (i.e., right end) of the back and forth movement.

The guide surface 106*b* abuts a linear portion of the bottom dead center position against the lower portion of the transfer roller casing 107*a* and positions the transfer roller 107 at the lowest position. Further, the guide surface 106*c* abuts the linear position of the bottom dead center position against the holder 108*a* and positions the transfer surface regulating roller 108 at the lowest position.

Therefore, while the slide cam 106 shifts from the press-contacting state illustrated in FIG. 8 to the separated state illustrated in FIG. 9, the transfer surface regulating roller 108 moves in the direction indicated by an arrow R3 illustrated in FIG. 9. Further, the transfer roller 107 moves in the direction indicated by an arrow R4 illustrated in FIG. 9.

When a tensile force applied to the intermediate transfer belt 31 (refer to FIG. 4) is released as illustrated in FIG. 10, the slide cam 106 is positioned at the termination position (i.e., right end) of the back and forth movement. This is similar to the separated state illustrated in FIG. 9. The slide cam 106 thus positions the transfer roller 107 and the transfer surface regulating roller 108 at the lowest positions.

When the user turns the operation lever 101 (refer to FIG. 4) from the separated state illustrated in FIG. 9 to the tensile force released state illustrated in FIG. 10, the projection 102*a* of the link arm 102 is detached from the slit 106*a* of the slide cam 106. As a result, the slide cam 106 does not move, and the heights of the transfer roller 107 and the transfer surface regulating roller 108 do not change.

When the user turns the operation lever 101 from the tensile force released state illustrated in FIG. 10 to the separated state illustrated in FIG. 9, the projection 102*a* of the link arm 102 is again held in the slit 106*a* of the slide cam 106.

When the user is to remove the intermediate transfer unit 30 from the image forming unit 51 illustrated in FIG. 3, the user turns the operation lever 101 clockwise by 90 degrees from a press-contacting state illustrated in FIG. 5. The operation lever 101 thus reaches the separated state illustrated in FIG. 6. The user then pulls out the intermediate transfer unit 30 towards the front direction from the image forming unit 51 while the operation lever 101 is perpendicularly turned.

At this time, the tensile force applied to the intermediate transfer belt 31 is maintained, so that damage to a belt member or to peripheral parts due to loosening of the intermediate transfer belt 31 can be prevented. Further, since one end of the operation lever 101 protrudes from the cross section surface along the rotational direction of the intermediate transfer belt 31, the user can easily understand that it is not possible to remove the intermediate transfer belt 31. Further, the operation lever 101, which is large and comfortable to grip, acts as a handle for pulling out the intermediate transfer unit 30 towards the front.

As described above, a user can perform a replacement operation of the intermediate transfer belt 31 or maintenance operation, such as checking and adjusting the intermediate transfer unit 30 after removing the intermediate transfer unit 30 from the image forming unit 51. The user further turns the operation lever 101 clockwise by 90 degrees from the separated state illustrated in FIG. 6 to the tensile force released state illustrated in FIG. 7.

Consequently, the projection 102*a* of the link arm 102 is detached from the slit 106*a* of the slide cam 106, and a force that moves the slide cam 106 is not generated even when the user turns the operation lever 101.

Further, by using the operation lever 101, whose lever radius is large, a user can release the tensile force applied to the intermediate transfer belt 31 with a small force and without applying an excessive force to a peripheral mechanism or the intermediate transfer unit 31.

According to the present exemplary embodiment, the abutting/separating mechanism (the slide cam 106) abuts and separates the toner-image conveyance belt (the intermediate transfer belt 31) against and from the image bearing member (the photosensitive drum 1). The moving mechanism (the linear guides 43 and 44) enables the toner image conveyance belt unit (the intermediate transfer unit 30), from which the intermediate transfer belt 31 has been removed by the abutting/separating mechanism (the slide cam 106), to move from an image forming position to a removal position.

Referring to FIG. 4, the release cam 111 is mounted on a front end of the rotary shaft 112 on which the operation lever 101 is integrally mounted. A release cam 121 is mounted on a back end of the rotary shaft 112. A tensile force mechanism CH including the release cam 111 is disposed on an external surface of the frame 131 of the intermediate transfer unit 30. Further, a tensile force mechanism CH including the release cam 121 is disposed on an external surface of the frame 132 of the intermediate transfer unit 30.

When a user grips and turns the operation lever 101, the release cams 111 and 121 integrally turn, and a pair of tensile force mechanisms CH equally controls the tension roller 33. The pair of tensile force mechanisms CH is similarly configured except that the mechanical arrangement is symmetrical. Therefore, the tensile force mechanism CH disposed on the frame 131 will be described below.

Figure 11:
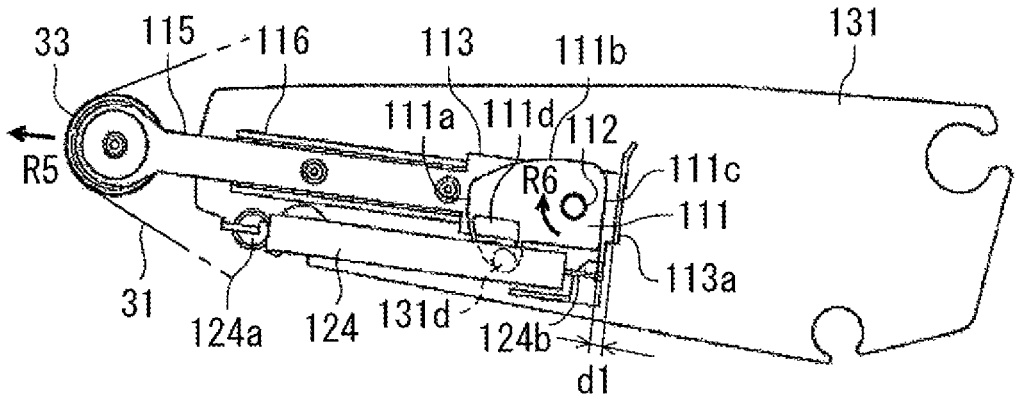
FIG. 11 illustrates a tensile force mechanism when the operation lever turned to a press-contact position.
Figure 12:
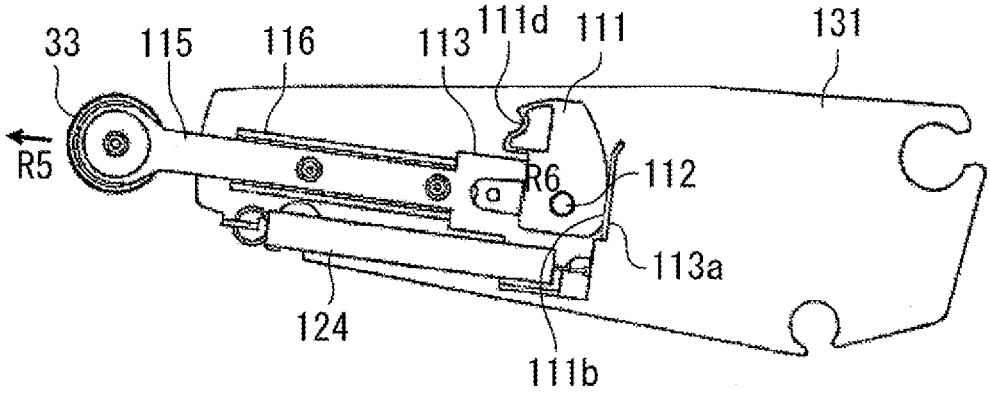
FIG. 12 illustrates the tensile force mechanism when the operation lever is turned to a separate position.
Figure 13:
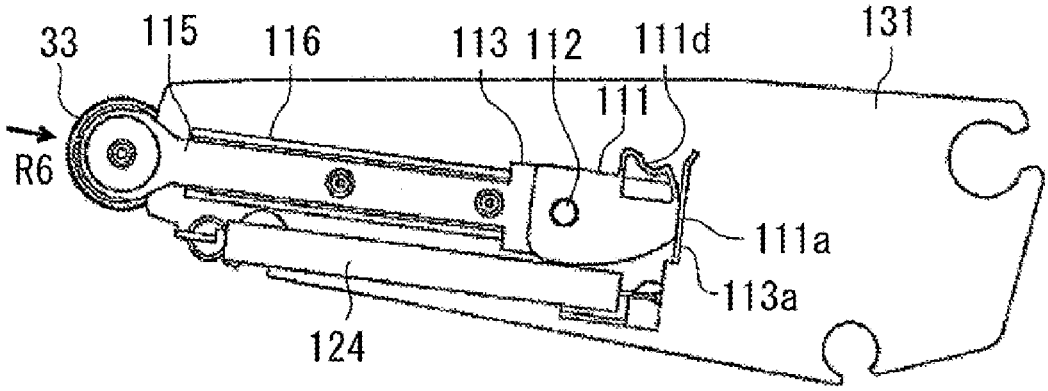
FIG. 13 illustrates the tensile force mechanism when the operation lever is turned to a release position.

FIG. 11 illustrates the tensile force mechanism when the user turns the operation lever 101 to the press-contact position. FIG. 12 illustrates the tensile force mechanism when the user turns the operation lever 101 to the separate position. FIG. 13 illustrates the tensile force mechanism when the user turns the operation lever 101 to the release position.

Referring to FIG. 11, the slider 113 is linearly movable in the direction along the slide rail 116 mounted on the frame 131. The tension roller 33 is pivotally supported to be rotatable by the bearing holder 115 mounted on the slider 113. A cam abutting portion 113*a* is disposed on the opposite side of the bearing holder 115 facing the release cam 111.

A fixed end 124*a* of the spring 124 is latched to the frame 131, while a free end 124*b* of the spring 124 is latched to the slider 113. Consequently, the spring 124 biases the slider 113 in a direction to push the tension roller 33 out in a direction indicated by an arrow R5 illustrated in FIG. 11.

When a user turns the operation lever 101 illustrated in FIG. 4, the release cam 111 is turned via the rotary shaft 112. Consequently, the cam surface that faces the cam abutting portion 113*a* of the slider 113 is changed among the cam surfaces 111*a*, 111*b*, and 111*c* of the release cam 111.

The release cam 111 works together with the cam abutting portion 113*a*, which is biased by the spring 124, to apply a stepwise operational feeling (i.e., a clicking feeling) to the operation lever 101 when a user turns the operation lever 101. Therefore, the release cam 111 also works as a detent mechanism that prevents the operation lever 101 from stopping at an intermediate position.

When the tensile force mechanism is in the press-contacting state illustrated in FIG. 11, the cam surface 111*c*, which forms a linear bottom dead center of the release cam 111, faces the cam abutting portion 113*a* of the slider 113. The slider 113 is positioned where a bias force of the spring 124 balances with a tensile force applied to the intermediate transfer belt 31, and a space d1 is formed between the cam surface 111*c* and the cam abutting portion 113*a*.

Further, as illustrated in FIG. 4, the release cam 121 on the back side rotates in conjunction with the lever rotary shaft 112. The release cam 121 thus causes the tensile force mechanism to operate similar as the release cam 111.

As a result, a predetermined tensile force according to the bias force of the spring 124 is applied to the intermediate transfer belt 31. That is, the release cam 111 does not affect the tensile force applied to the intermediate transfer belt 31.

However, since the space d1 is formed and the cam abutting portion 113*a* does not limit the rotation of the release cam 111, the cam abutting portion 113*a* cannot maintain the operation lever 101 in a horizontal position.

To solve the problem, an elastic claw 111*d* disposed on the release cam 111 holds the latching pin 131*d* mounted on the frame 131 to maintain the release cam 111 in a horizontal position. The elastic claw 111*d* is released from holding the latching pin 131*d* at the beginning of turning of the operation lever 101 (refer to FIG. 5). The operation lever 101 is locked at the end of a restoring operation.

When the tensile force mechanism is in the separated state illustrated in FIG. 12, the cam surface 111*b*, which is an intermediate point of a linear portion of the release cam 111, abuts against the cam abutting portion 113*a* of the slider 113. The slider 113 abuts against the cam surface 111*b* and locks the rotation of the release cam 111 while slider 113 is at a position where the bias force of the spring 124 balances with the tensile force applied to the intermediate transfer belt 31. The slider 113 thus holds the operation lever 101 illustrated in FIG. 6 in a vertical position.

Then, as illustrated in FIG. 4, the release cam 121 on the back side rotates in conjunction with the rotary shaft 112 and operates the tensile mechanism CH similar as the release cam 111.

Therefore, a tensile force that is equivalent to the bias force of the spring 124 from which a pressing force of the cam surface 111*b* is subtracted, is applied to the intermediate transfer belt 31. As a result, the intermediate transfer belt 31 neither slacks nor hangs down below the intermediate transfer unit 30.

When the tensile force mechanism is in the tensile force released state illustrated in FIG. 13, the cam surface 111*a*, which is the top dead center of a linear portion of the release cam 111, abuts against the cam abutting portion 113*a* of the slider 113. The slider 113 expands the spring 124 and moves in a direction indicated by an arrow R6 illustrated in FIG. 13, and is supported by the release cam 111 via the cam surface 111*a* under the bias force of the spring 124.

Further, the linear portion of the cam surface 111*a* of the release cam 111 contacts a flat surface of the cam abutting portion 113*a* of the slider 113 and is pressurized. Consequently, the operation lever 101 (refer to FIG. 7) is locked.

Further, as illustrated in FIG. 4, the release cam 121 on the back side rotates in conjunction with the rotary shaft 112 and causes the tensile force mechanism CH to operate similar as the release cam 111.

As a result, the tension roller 33 supported by the bearing holder 115 moves in the direction indicated by the arrow R6 illustrated in FIG. 13, so that the tensile force applied to the intermediate transfer belt 31 is completely released. The intermediate transfer belt 31 thus hangs down below the intermediate transfer unit 30 as illustrated in FIG. 7.

Referring to FIG. 7, when a user is to remove the intermediate transfer belt 31 in a periodic replacement, the user turns the operation lever 101 clockwise from the press-contact position illustrated in FIG. 5 to a position of 180 degrees.

As illustrated in FIG. 4, the release cams 111 and 121 then move together to release the tensile force of the tensile force mechanism CH. Then, the user slides the intermediate transfer belt 31 in an axial direction of the tension roller 33 and removes the intermediate transfer belt 31 from the intermediate transfer unit 30.

The frame 131 is formed smaller in area than the cross section surface along the rotational direction of the intermediate transfer belt 31. Consequently, the intermediate transfer belt 31 can be removed from the front side of the intermediate transfer unit 30.

When the user returns the intermediate transfer unit 30 to the image forming unit 51, the user turns the operation lever 101 counterclockwise by 90 degrees from the tensile force released state illustrated in FIG. 7 to the separated state illustrated FIG. 12. During the above process, a phase position at which the release cam 111 contacts the cam abutting portion 113*a* of the slider 113 gradually shifts from the cam surface 111*a* (the top dead center) to the cam surface 111*b* (the intermediate point).

Accordingly, the slider 113 is pulled by the spring 124 and moves in the direction indicated by the arrow R5 illustrated in FIG. 12, to gradually apply a tensile force to the intermediate transfer belt 31. When the user turns the operation lever 101 to the phase of the cam surface 111*b*, i.e., the intermediate point, almost a predetermined tensile force is applied to the intermediate transfer belt 31. The intermediate transfer unit 30 thus returns to a state in which there is no slack in the intermediate transfer belt 31. The user can then return the intermediate transfer unit 30 to the image forming unit 51 as illustrated in FIG. 3.

After finishing the maintenance of the intermediate transfer unit 30, the user pushes the intermediate transfer unit 30 back into the image forming unit 51. Then, the user further turns the operation lever 101 by 90 degrees counterclockwise.

Consequently, a predetermined tensile force is applied to the intermediate transfer belt 31 as illustrated in FIG. 11. The cam abutting portion 113*a* of the slider does not abut against the release cam 111, so that the space d1 is formed.

As a result, the intermediate transfer belt 31 does not slack as illustrated in FIG. 5 and can be used for an image forming process.

When the tensile force mechanism is in the image forming state illustrated in FIG. 11, the elastic claw 111*d* of the release cam 111 engages the latching pin 131*d* mounted on the frame 131 to limit the rotation of the release cam 111.

Therefore, as illustrated in FIG. 4, the release cams 111 and 121 cannot rotate, and the space d1 is secured.

A user can turn the operation lever 101 to rotate the release cams 111 and 121, to engage and disengage the elastic claw 111*d* and the latching pin 131*d* with a moderate click feeling.

According to the first exemplary embodiment, a user can perform the following processes by turning one operation lever 101. That is, the user can separate the intermediate transfer belt 31 from the photosensitive drum 1 to mount and remove the intermediate transfer unit 30. The user can also release a tensile force applied to the intermediate transfer belt 31 to mount and remove the intermediate transfer belt 31.

Further, the intermediate transfer unit 30 can be designed to be thin and compact by including the operation lever 101 inside a projected area of the intermediate transfer unit 30 in press-contacting and tensile force released states.

Further, since a portion of the intermediate transfer belt 31 is moved to separate the intermediate transfer belt 31 from the photosensitive drum 1, it is not necessary to move the entire intermediate transfer unit 30 in a separating direction. Therefore, the intermediate transfer belt 31 can be abutted against and separated from the photosensitive drum 1 with a small force.

In addition, it is not necessary to secure a large clearance between a unit disposed on the opposite side of separation, compared to a case where the entire intermediate transfer unit 30 is moved in a separating direction. As a result, the image forming apparatus 50 can be downsized at a low cost by compactly incorporating the units into the image forming unit 51.

Further, the intermediate transfer belt 31 does not slack when the intermediate transfer unit 30 or neighboring units are mounted or removed. Consequently, the belt is rarely damaged.

Further, the operation lever 101 protrudes from the intermediate transfer unit 30 when the user attaches the intermediate transfer unit 30. Therefore, the user can use the operation lever 101 as a handle when pulling out the intermediate transfer unit 30.

Further, since the operation lever 101 protrudes from the intermediate transfer unit 30 when the user has pulled out the intermediate transfer unit 30, the user can easily see and determine that the intermediate transfer belt 31 cannot be replaced.

Further, since the operation lever 101 and the frame 131 are contained within the projection area of the intermediate transfer belt 31, a user can easily replace the intermediate transfer belt 31.

In particular, in a case where a thin intermediate transfer unit 30 is disposed, a long operation lever can be used. Consequently, such an operation lever is useful when releasing a large load, such as a tensile force, applied to the intermediate transfer belt 31.

Therefore, the intermediate transfer unit 30 and neighboring units that are removably mounted on the image forming unit 51 can be mounted on and removed from the image forming unit 51 within a small space and without damage. Further, a user-friendly image forming apparatus 50 can be provided, where a user can easily replace the intermediate transfer belt 31.

As described above, according to the first exemplary embodiment, the tensile force releasing mechanism (the release cam 111) reduces the tensile force of the toner-image conveyance belt (the intermediate transfer belt 31). Consequently, the toner-image conveyance belt (the intermediate transfer belt 31) can be removed from the supporting mechanism at a removal position. The transmission mechanism (the rotary shaft 112) transmits a driving force generated by the operation of the operation unit (the operation lever 101) to the abutting/separating mechanism (the slide cam 106) and the tensile force releasing mechanism (the release cam 111). The driving force transmitted via the transmission mechanism (the rotary shaft 112) separates the toner-image conveyance belt (the intermediate transfer belt 31) from the image bearing member (the photosensitive drum 1) and reduces the tensile force applied to the toner-image conveyance belt (the intermediate transfer belt 31).

Figure 14:
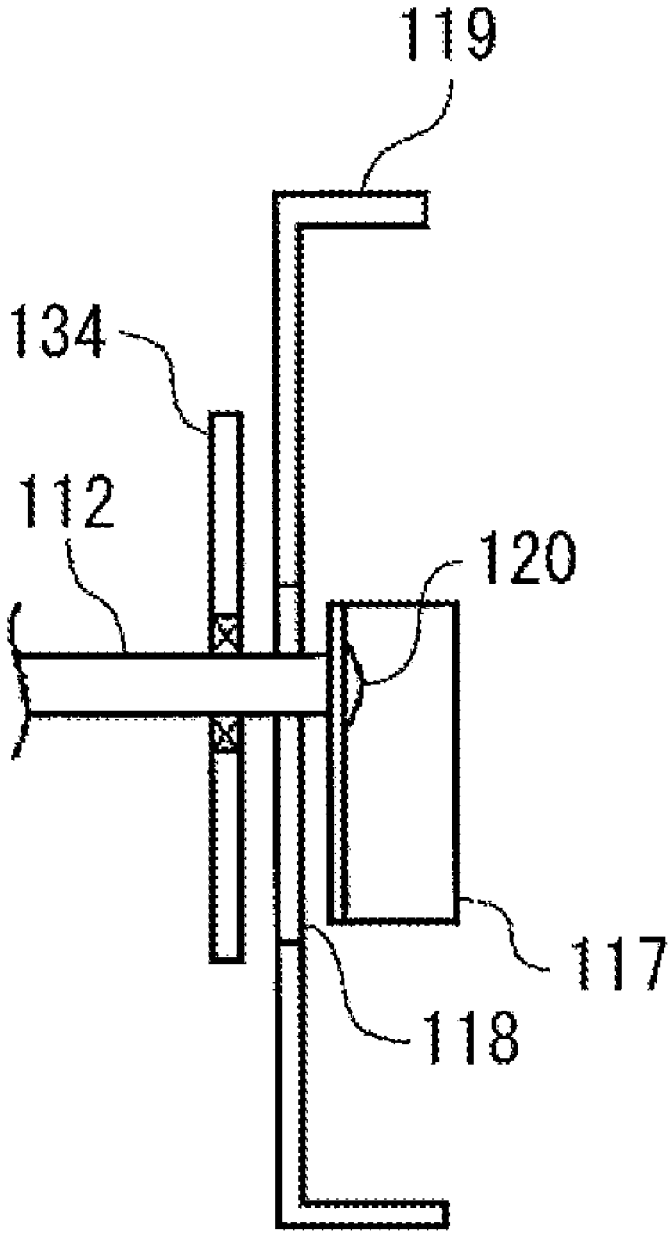
FIG. 14 illustrates a rear side lock mechanism of the intermediate transfer unit.
Figure 15:
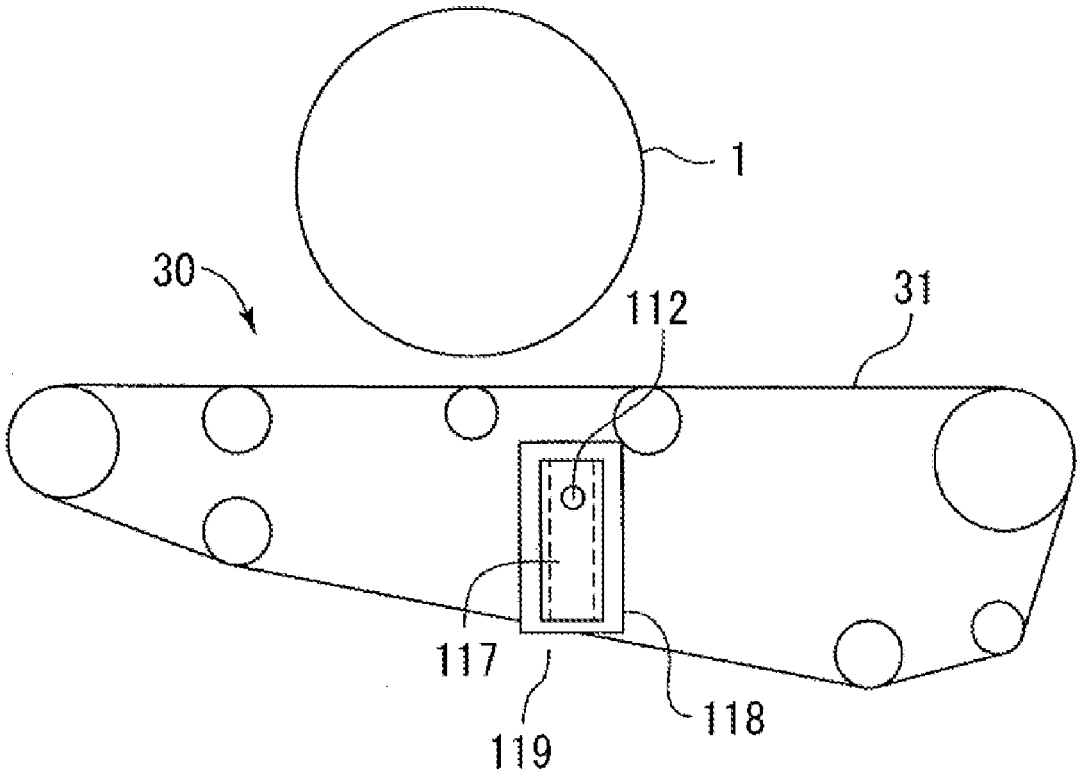
FIG. 15 illustrates the rear side lock mechanism in a released state.
Figure 16:
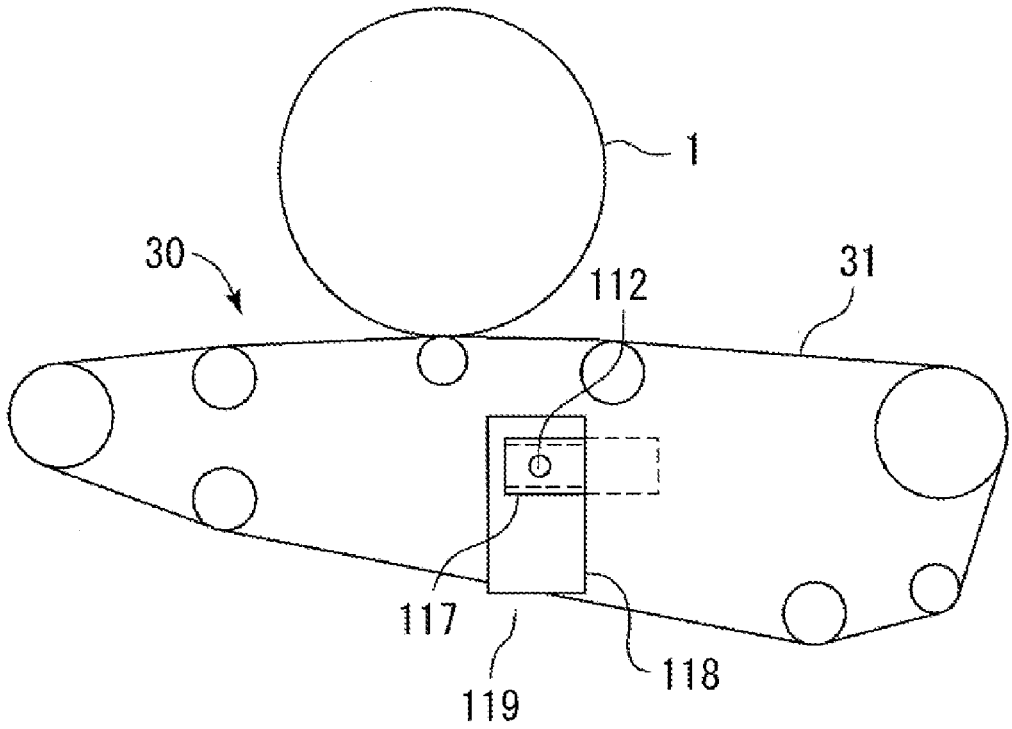
FIG. 16 illustrates the rear side lock mechanism in a press-contacting state.
Figure 17:
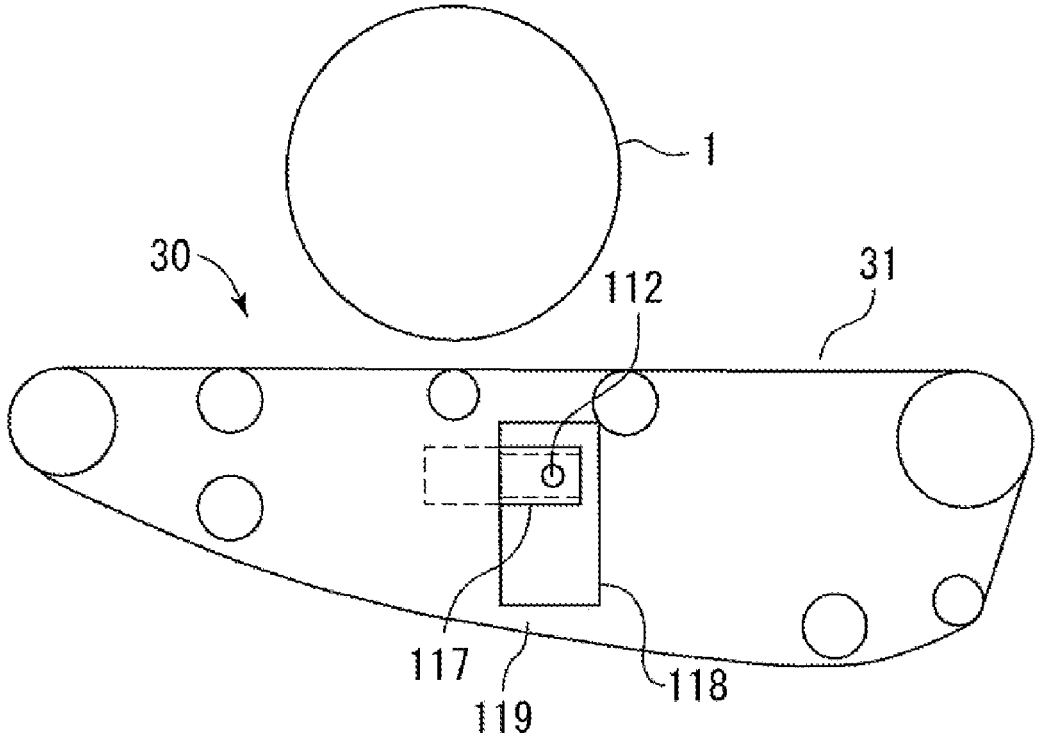
FIG. 17 illustrates the rear side lock mechanism in a tensile force released state.

FIG. 14 illustrates a back lock mechanism of the intermediate transfer unit 30. FIGS. 15, 16, and 17 illustrate the back lock mechanism in a released state, a press-contacting state, and a tensile force released state, respectively.

Referring to FIG. 14, a pullout lock member 117 is integrally mounted on one end of the rotary shaft 112 of the operation lever 101 by a fixing screw 120. The pullout lock member 117 integrally rotates with the operation lever 101 in the back side of an apparatus body back frame 119 mounted on the image forming unit 51 of the image forming apparatus 50 illustrated in FIG. 3.

Referring to FIG. 15, when the intermediate transfer belt 31 is separated from the photosensitive drum 1, the pullout lock member 117 is positioned within an aperture 118 formed on the apparatus body back frame 119. The pullout lock member 117 releases a lock on the intermediate transfer unit 30 with respect to the apparatus body back frame 119. The aperture 118 is set to be larger than the pullout lock member 117 on a projection area in a pullout direction.

Therefore, if a user turns the operation lever 101 90 degrees and separates the intermediate transfer belt 31 from the photosensitive drum 1 as illustrated in FIG. 6, the user can grab the operation lever 101 to pull out the intermediate transfer unit 30 towards the front direction as illustrated in FIG. 3.

However, when the intermediate transfer belt 31 press-contacts the photosensitive drum 1 as illustrated in FIG. 16, the pullout lock member 117 is positioned outside the aperture 118 behind the apparatus body back frame 119.

As a result, when the user does not turn the operation lever 101, the intermediate transfer unit 30 is in a normal state. Then, the intermediate transfer unit 30 is interfered by the apparatus body back frame 119, so that the user cannot pull out the intermediate transfer unit 30 towards the front direction.

Therefore, the user cannot pull out the intermediate transfer unit 30 towards the front direction by mistake while the intermediate transfer belt 31 press-contacts the photosensitive drum 1. Consequently, there is no danger that the lifetime of the intermediate transfer belt 31 shortens or the intermediate transfer belt 31 receives damages.

Referring to FIG. 17, when the user turns the operation lever 101 by 180 degrees, the tensile force applied to the intermediate transfer belt 31 is released. Then, the pullout lock member 117 is positioned outside the aperture 118 behind the apparatus body back frame 119 again.

Consequently, when the tensile force applied to the intermediate transfer belt 31 is released, the intermediate transfer unit 30 is interfered by the apparatus body back frame 119, so that the user cannot pull out the intermediate transfer unit 30 towards the front direction.

Therefore, a user cannot pull out the intermediate transfer unit 30 towards the front by mistake while the intermediate transfer belt 31 is hanging down. As a result, there is no danger that the lifetime of the intermediate transfer belt 31 shortens or the intermediate transfer belt 31 receives damages.

As described above, according to the first exemplary embodiment, when the operation unit (the operation lever 101) is at the second position (the separate position P1), the toner-image conveyance belt unit (the intermediate transfer unit 30) can be moved from the image forming position to the removal position. The lock mechanism (the pullout lock mechanism 117) fixes the toner-image conveyance belt unit (the intermediate transfer unit 30) to the image forming position when the operation unit (the operation lever 101) is in the first position (the press-contact position P0).

Second Exemplary Embodiment

The first exemplary embodiment illustrates the intermediate transfer unit 30 including the intermediate transfer belt 31, which is removably mounted on the image forming unit.

However, the present invention can also be realized by a recoding material conveyance belt unit including a recording material conveyance belt, which is removably mounted on the image forming unit (refer to FIG. 3).

In a second exemplary embodiment, the image forming apparatus includes a release cam 111 (refer to FIG. 11), which moves the tension roller in and out in the longitudinal direction of a cross section surface along the rotational direction of the recording material conveyance belt. Further, the image forming apparatus includes a slide cam 106 (refer to FIG. 8), which moves the transfer roller in the longitudinal direction of the cross section surface along the rotational direction of the recording material conveyance belt. The release cam 111 and the slide cam 106 are driven in different rotation areas by a common operation lever 101 (refer to FIG. 5).

As a result, a user can perform the following processes by turning one operation lever. That is, the user can separate the recording material conveyance belt from the photosensitive drum for mounting and removing it. The user can also release a tensile force applied to the recording material conveyance belt for mounting and removing it.

Further, the recording member conveyance belt unit can be designed to be thin and compact by containing the operation lever inside a projected area of the recording material conveyance belt unit in press-contacting and tensile force released states.

Third Exemplary Embodiment

The first exemplary embodiment describes a single drum type image forming apparatus in which one photosensitive drum 1 is disposed along the intermediate transfer belt 31.

However, the present invention can also be applied to a tandem type image forming apparatus in which a plurality of photosensitive drums are disposed along an intermediate transfer belt or a recording material conveyance belt. Each of the plurality of photosensitive drums bears a toner image whose developing color is different.

In a third exemplary embodiment, a plurality of photosensitive drums are disposed to press-contact an exterior surface of an intermediate transfer belt. Transfer rollers are disposed to press contact the respective photosensitive drums via the intermediate transfer belt. Further, the image forming apparatus includes a slide cam 106 (refer to FIG. 8) with guide surfaces 106*a*, 106*b*, and 106*c* for moving each of the transfer rollers respectively in a direction of a narrow side of a cross section surface along a rotational direction of the intermediate transfer belt. A common operation lever 101 (refer to FIG. 5) drives both a mechanism for releasing a tensile force applied to the intermediate transfer belt and the slide cam 106, which simultaneously separates the plurality of transfer rollers in respective different rotation regions.

As described above, in an image forming apparatus according to an exemplary embodiment of the present invention, a user can operate a separating mechanism and a loosening mechanism using one operation lever. As a result, a user's erroneous operation can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-279449 filed Oct. 26, 2007, which is hereby incorporated by reference herein in its entirety.

What is claimed is:

1. An image forming apparatus comprising:

an image bearing member;

a belt member configured to be rotatable and to contact the image bearing member;

a belt unit configured to support the belt member and removably mounted on the image forming apparatus;

an operation unit disposed on the belt unit;

a belt unit moving mechanism configured to cause the belt member to contact the image bearing member when the operation unit is in a first position, and to cause the belt member to separate from the image bearing member when the operation unit is in a second position;

a tensile force releasing mechanism configured to release a tensile force applied to the belt member when the belt unit is pulled out from the image forming apparatus and the operation unit is in a third position; and a locking unit configured to lock the belt unit to the image forming apparatus so that the belt unit is not removed from the image forming apparatus, when the operation unit is in the third position while the belt unit is mounted on the image forming apparatus.

2. An image forming apparatus according to claim 1, wherein the tensile force is released when the operation unit moves to the third position via the second position.

3. An image forming apparatus according to claim 1, wherein the tensile force applied to the belt member is not released when the operation unit is in the second position.

4. An image forming apparatus according to claim 1, wherein the operation unit and the belt member overlap each other in a rotation axis direction of the belt member when the operation unit is in the second position.

5. An image forming apparatus according to claim 1, wherein the operation unit and the belt member do not overlap each other in a rotation axis direction of the belt member when the operation unit is in the third position.

6. An image forming apparatus according to claim 1, further comprising a lock mechanism configured to enable the belt unit to move from an image forming position to a removal position when the operation unit is in the second position, and to lock the belt unit in the image forming position when the operation unit is in the first position.

7. An image forming apparatus according to claim 1, wherein the belt member includes an intermediate transfer belt configured to bear a toner image.

8. An image forming apparatus according to claim 1, wherein the belt member includes a recording material bearing belt configured to bear a recording material.

* * * * *